United States Patent [19]

Krupen

[11] 4,183,303

[45] Jan. 15, 1980

[54] PROXIMITY FUZE

[75] Inventor: Philip Krupen, Silver Spring, Md.

[73] Assignee: The United States of America as represented by the Secretary of the Army, Washington, D.C.

[21] Appl. No.: 275,779

[22] Filed: Feb. 25, 1963

[51] Int. Cl.[2] ..... F42C 13/00

[52] U.S. Cl. ..... 102/211

[58] Field of Search ..... 102/70.2, 18, 19.2, 102/70.2 P, 70.2 G, 70.2 GI, 211

[56] References Cited

U.S. PATENT DOCUMENTS

| | | | |
|---|---|---|---|
| 2,238,072 | 4/1941 | Nelson et al. | 102/18 |
| 2,505,042 | 4/1950 | Gourdon | 102/211 |
| 2,993,440 | 7/1961 | Chubb et al. | 102/18 |

*Primary Examiner*—Charles T. Jordan

*Attorney, Agent, or Firm*—Nathan Edelberg; Robert P. Gibson; Saul Elbaum

EXEMPLARY CLAIM

1. A voltage-gradient sensitive proximity fuze for use with a rotating projectile against electrostatically charged targets and which will detonate the projectile at an optimum distance from the target comprising: p1

(a) a pair of conducting electrostatic probes, said electrostatic probes being arranged symmetrically with respect to a plane of symmetry containing the longitudinal center axis of the projectile, said probes being of such limited circumferential extent that a voltage-gradient is developed between said probes when the longitudinal center axis of the projectile is at an angle to an external electrostatic field, whereby the fuze will have a high voltage-gradient sensitivity in a direction transverse to said longitudinal center axis;

(b) a voltage sensitive electronic firing circuit, said pair of conducting electrostatic probes connected to said circuit to cause said circuit to detonate said projectile when the voltage difference between said probes exceeds a predetermined amount.

3 Claims, 5 Drawing Figures

PROXIMITY FUZE

The invention described herein may be manufactured and used by or for the Government of the United States of America for governmental purposes without the payment of any royalty thereon.

This invention relates to ammunition fuzing, and more particularly to a passive electrostatic proximity fuze.

In many situations, especially with small ammunition such as 40-millimeter shells used for the defense of ships and bombers against attacking aircraft and missiles, it is desirable to have the fuze detonate the shell at a point of approach close to the target. Additionally, fuzing for such small pieces of ammunition which are designed to be used in great quantity, must be compact and inexpensive.

An object of this invention is to provide a small, compact, inexpensive fuze for use with rotating ammunition.

Another object of the present invention is to provide a fuze which is relatively immune to known countermeasures that could practicably be incorporated in an enemy missile or aircraft.

A further object of the invention is to provide a fuze which will function at a point of approach close to an enemy target.

A still further object is to provide an electrostatic fuze which does not depend upon the closing rate between the munition and the target.

Still another object of the present invention is to provide an electrostatic fuze having maximum sensitivity in a direction transverse to the longitudinal axis of munition which carries the fuze.

An additional object of the invention is to provide a fuze to be used in combination with a rotating projectile which produces an AC signal of known and constant frequency.

Yet another object of the present invention is to provide a passive uncharge electrostatic fuze, for use against electrostatically charged targets.

It is well known that aircraft and missiles become electrostatically charged in flight, and that they are discharged by natural means. This discharge is produced because a potential relative to the surrounding atmosphere is built up on the airplane or missile. The potential will rise rapidly until the discharging rate is nearly equal in magnitude to the charging rate and the aircraft may be considered to be in a state of equalibrium unless extremely fast changes occur in the charging rate. It should be noted also that the field intensities on a target or missile vary with the geometry of the target or missile. For example, where the radius of curvature is smaller, the field intensity is larger.

The fuze of this invention operates without itself being electrostatically charged, and comprises a pair of probes, an electronic detonating circuit, a power supply and an arming mechanism. An alternating potential difference is developed between the probes, as the ammunition rotates with its longitidunal axis at an angle to the electrostatic field surrounding a charged target. This AC signal is fed into an electronic circuit which, if desired, may include an amplifier stage. The power required for operation of the electronic circuit in any event is low because the number of electronic components is small. Also the tolerances are not critical, making production cost of the passive electrostatic fuze of this invention very low.

The specific nature of the invention, as well as other objects, uses and advantages thereof, will clearly appear from the following description and from the accompanying drawing, in which.

The present invention provides a fuze which is voltage-gradient sensitive, with a maximum voltage-gradient sensitivity in a direction transverse to the longitudinal axis of a missile or round of ammunition in which it is placed.

Figure 1:
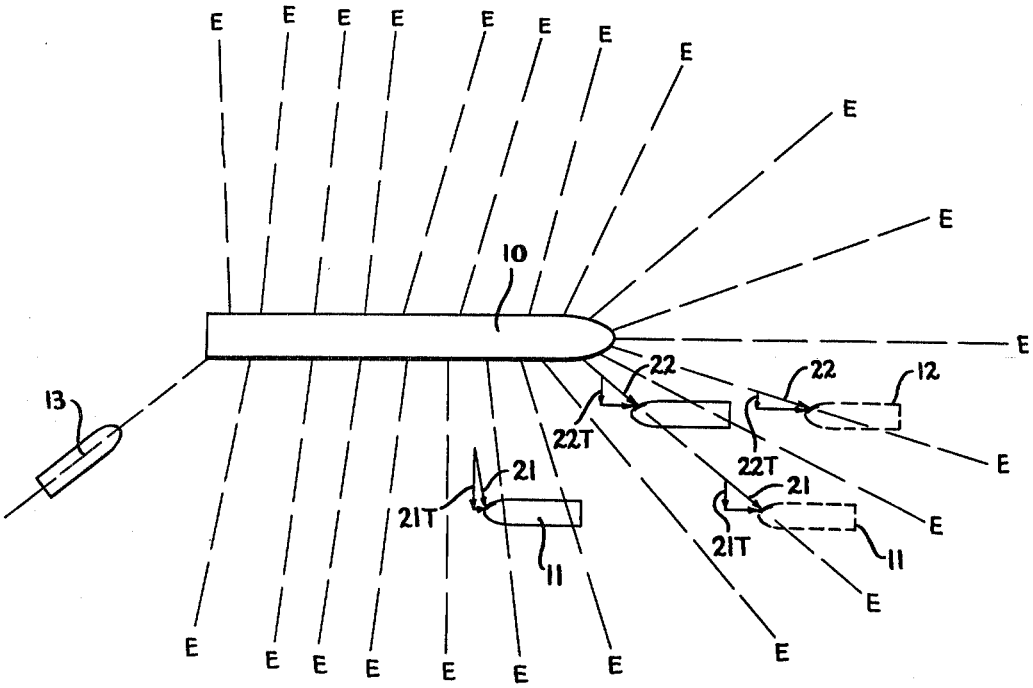
FIG. 1 is a pictorial representation of an enemy target and ammunition approaching along varying paths representing different miss distances.

FIG. 1 shows a target 10 and missiles 11, 12, 13 aimed at the target with varying degrees of accuracy, i. e., different miss distances. Although the field pattern in the vicinity of an aircraft or missile is complex, a simplified system has been hypothesized and is represented by the dotted lines of decreasing intensity radiating from the target 10, which estimate the intensity and direction of the field at point outside the target.

A round 11, having a relatively large miss distance, passes within the electrostatic field generated by the electrostatic charges accumulated on the target 10. Sensing means in the missel 11, to be described below, have a maximum voltage-gradient sensitivity in a direction transverse to the longitudinal axis of the round 11. At each position of the round 11 illustrated, the sensing means associated will be subject to a voltage-gradient, the direction in magnitude of which is indicated by a vector arrow 21. The magnitude of the transverse component 21T becomes sufficient to actuate the detonating circuit and cause detonation of the explosive means carried by the missile 11 when the round 11 is in the position shown in the full line drawing, although the magnitude of the vecot 21 has remained relatively constant.

A second more accurately aimed missile 12 will not be activated when it is a distance comparable to the detonating distance for the missile 11. This comparable position of the missile 12 is illustrated in the dotted line representation of FIG. 1. In this position, the voltage-gradient represented by the magnitude of the vector 22 will be equal to that represented by the vector 21. This would be the voltage-gradient which would be sensed assuming that the sensing means were equally responsive in all directions. However, the sensing means has maximum sensitivity in the direction transversed to the longitudinal axis of the missile. The vector of the voltage-gradient which is transversed to the longitudinal axis of the missile 12 is represented by the vector 22T and is smaller in magnitude than either the vector 22 or the vector 21T. Accordingly, the means for the detonator is not activated at this dotted line position. However when the missile 12 reaches the solid line position illustrated, the voltage-gradient that would be sensed if the sensing means were equally active in all directions increases to a magnitude indicated again by a vector 22, such vector being normal to the imaginary voltage contour equal potential lines surrounding the target. The vector 22 is of just enough magnitude to make the transverse vector 22T equal in magnitude to the vector 21T and the detonator is activated.

In the case of zero miss distance, there may be little or no voltage-gradient in the direction transverse to the longitudinal axis of the round, because the round may follow the electrostatic lines of force established by the electrostatic field surrounding the target 10. Such a circumstance is illustrated by the round 13. Under such a condition it is desirable for the round to approach very close to the target before detonation. Detonation in this special case occurs because of secondary effects, such as the change in capacitance between the probes on close approach to the target, and/or shorting of the probes on contact, and/or the electrostatic signal due to the high strength of the electrostatic field close to the target.

Figure 2:
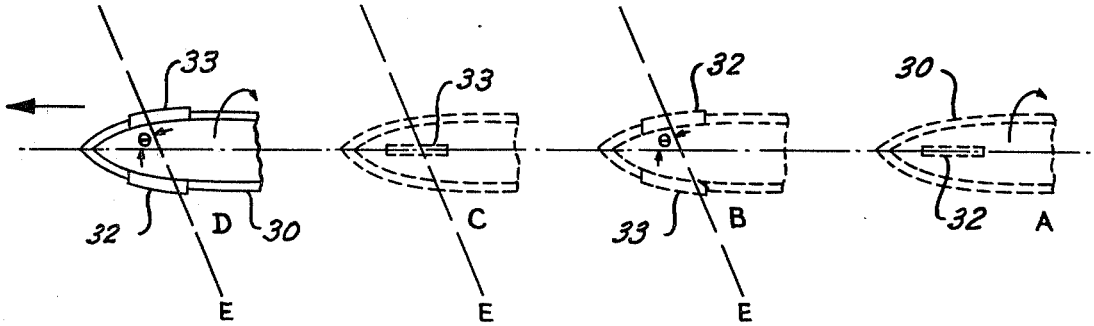
FIG. 2 is a representation of a missile showing the fuze probes of this invention passing through one revolution.
Figure 3:
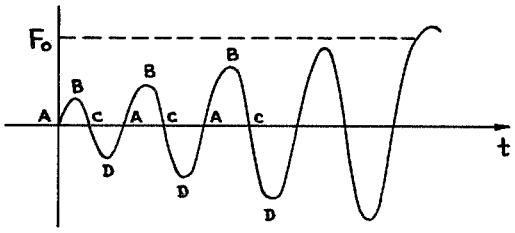
FIG. 3 shows the AC signal developed by the ammunition of FIG. 2 as it passes through an increasing electrostatic field.

The generation of a signal having maximum sensitivity in a transverse direction with the passive electrostatic fuze of this invention will be explained in connection with FIGS. 2 and 3. FIG. 2 shows several positions A, B, C and D of a rotating round or missile 30 as it travels in the direction indicated by the arrow. The corresponding points are indicated in FIG. 3 which represents the electrical signal between the probes 32 and 33. The two probes 32 and 33 are located on the outer surface of the forward part of the projectile, and are arranged symmetrically with respect to a plane of symmetry containing the longitudinal center axis of the projectile 30. The probes 32 and 33 are rectangular in shape with the long dimension of each probe along the axis of the missile. The circumferential extent of the probes is limited so that a voltage-gradient will be developed between them when they pass through an electrostatic field with a component transverse to the center axis of the missile 30.

A signal is developed between the probes 32 and 33 as the projectile 30 enters an electrostatic field E. The maximum open circuit signal $V_m$ is proportional to the field intensity E, $$V_m = k\,E \tag{1}$$

where k is a coupling coefficient which represents the effective separation between the fuze probes. It is difficult to ascribe a value to k because it depends critically on the size and shape of the probes, dynamic factors associated with the target speed of approach, and on the effect of any nearby material which might act as a shield, such as the body of the ammunition. Applicant has determined experimentally a value of k on the order of 0.12 cm for a 40 millimeter antiaircraft shell with a 2 cm separation of the probes.

The signal which will be produced in an approaching electrostatic fuze depends not only on the potential of the aircraft but also on the concomitant field pattern and on its coupling to the fuze electrodes. As can be seen in FIGS. 2 and 3, the passive electrostatic fuze has a maximum voltage-gradient sensitivity in a direction transverse to the longitudinal axis of the missile so that the detonating signal is reduced when the line of flight of the ammunition is not normal to the electrostatic lines of forces. In general, the peak signal is:

$$Vo = Vm \sin\theta \tag{2}$$

where $\theta$ is the acute angle between the electric field vector E and the longitudinal axis of the missile X as shown in FIG. 2.

Since the projectile is rotating, the signal developed V is actually an alternating potential, $$V = Vo \sin\omega t = KE \sin\theta \sin\omega t \tag{3}$$

where;

$\omega = 2\pi f$ f = spin rate of the shell t = time

FIG. 3 represents the increasing sinusodial voltage developed between the probe 32 and 33 of the rotating projectile 30. In position A of FIG. 2 the probes 32 and 33 are an equal distance from the source of electrostatic potential and the voltage-gradient between them is zero. In position B missile 30 has rotated 90° during its flight from A to B. Here the probe 32 is closer to the source electrostatic potential than the probe 33 and the voltage-gradient between the plates 32 and 33 is a maximum, as is represented in FIG. 3. Traveling from the position B to the position C projectile 30 again rotates through 90° and the plates 32 and 33 are an equal distance from the source and the voltage-gradient is again zero. An additional 90° rotation brings the missile 30 to the position illustrated at D. Position D is the opposite of position B with a maximum voltage-gradient between the 32 and 33, the polarity merely having been reversed.

As the field intensity increases along the path of a projectile, such as round 11 in FIG. 1, the maximum voltage-gradient between the probes increases until a firing potential $f_o$, shown in FIG. 3, is reached at which time the detonating circuit of the fuze is triggered. Since the spin of the projectile 30 imparted by the rifling in the barrel is substantially fixed, and also constant throughout the flight of the projectile, a tuned amplifier stage may be advantageously employed to increase the detonating signal when desired.

Figure 4:
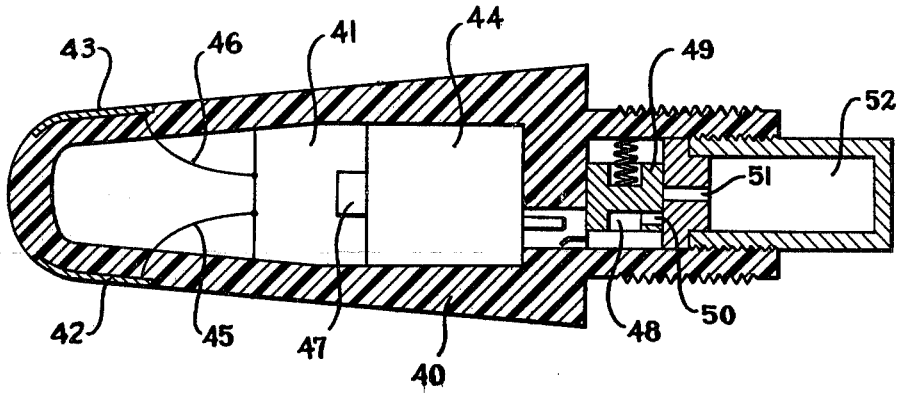
FIG. 4 is a cross-sectional view showing one arrangement of fuze components within the ammunition.

FIG. 4 represents one specific embodiment of a fuze designed for a 40 millimeter antiaircraft shell. The fuze has a casing 40 with electrostatic probes 42 and 43 located on or near the outer surface of the forward part of the projectile. The probes 42 and 43 are insulated from the casing 40 and are connected to a detonating circuit 41 by leads 45 and 46. Aft of the detonating circuit 41 is a power supply 44 which is activated by a power supply initiator 47. Connected to the detonating circuit 41 is an electrical detonator 48. Surrounding the electrical detonator 48 is a safety and arming means 49 which prevents accidental firing of the round in the event the electrical detonator 48 is prematurely activated. After firing, centrifugal force developed by the rotating projectile brings a port 50 into alinement with an explosive lead 51 and booster explosive 52 causing firing of the round when the detonator 48 is triggered. It should be noted that any of a number of arrangements of detonator circuit, power supply, and safety and arming means may be used in accordance with the principles of this invention.

Figure 5:
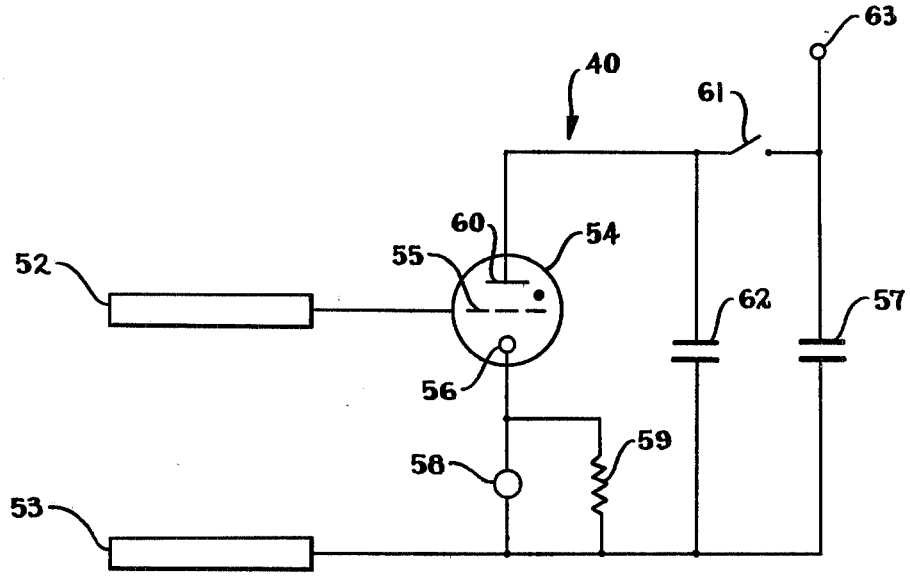
FIG. 5 is a schematic diagram of a detonating circuit.

FIG. 5 shows a simple single tube circuit that is a satisfactory detonating circuit for the passive electrostatic fuze of this invention. The circuit is comprised of a cold cathode gas type trigger tube 54, in which the grid 55 of the tube may serve as a voltage sensitive gating member. The cathode 56 of the tube 54 is connected to the negatively charged terminal of a power source, such as a charged capacitor 57, through an electrically responsive detonator 58. The cathode 56 is also connected to one of the pair of probes 53 through the detonator 58. A resistor 59 is provided between the cathode 56 and the negative terminal of the capacitor 57. This resistor constitutes a high resistance shunt to the detonator 58 to insure that the cathode 56 will always start operation at the potential of the negatively charged terminal of the capacitor 57.

The plate 60 of the cold cathode gas type trigger tube 54 is connected to the positively charged terminal of the capacitor 57. An arming switch 61 is provided in the circuit and preferably there is also provided in the circuit a second small capacitor 62, which is initially uncharged and is shunted across the arming switch 61 and the power capacitor 57. The capacitor 62 prevents a transient from prematurely activating the detonator 58 when the arming switch 61 is closed. The power capacitor 57 is charged before firing by means of a terminal 63 in any of a number of ways well known in the art.

It should be noted that the detonating circuit shown in FIG. 5 is merely one of a number of circuits which may be used in accordance with the teaching of this invention. For example, a two tube hot cathode circuit shown in my co-pending application Ser. No. 237,764, filed Nov. 14, 1962, now U.S. Pat. No. 3,882,781, may also be used. The two tube circuit has the advantage of being able to provide amplification, while the single tube circuit shown in FIG. 5 of the present application has the advantage of low power supply requirements.

It will be apparent that the embodiment shown is only exemplary and that various modifications can be made in the construction and arrangement within the scope of the invention as defined in the appended claims.

I claim as my invention:

1. A voltage-gradient sensitive proximity fuze for use with a rotating projectile against electrostatically charged targets and which will detonate the projectile at an optimum distance from the target comprising:

(a) a pair of conducting electrostatic probes, said electrostatic probes being arranged symmetrically with respect to a plane of symmetry containing the longitudinal center axis of the projectile, said probes being of such limited circumferential extent that a voltage-gradient is developed between said probes when the longitudinal center axis of the projectile is at an angle to an external electrostatic field, whereby the fuze will have a high voltage-gradient sensitivity in a direction transverse to said longitudinal center axis;

(b) a voltage sensitive electronic firing circuit, said pair of conducting electrostatic probes connected to said circuit to cause said circuit to detonate said projectile when the voltage difference between said probes exceeds a predetermined amount.

2. A voltage-gradient sensitive proximity fuze for use with a rotating projectile against electrostatically charged targets, and which will detonate the projectile at an optimum distance from the target, comprising:

(a) a pair of conducting electrostatic probes, said electrostatic probes being arranged symmetrically with respect to a plane of symmetry containing the longitudinal center axis of the projectile, said probes being rectangular in shape with the long dimension of the probe parallel to the longitudinal center axis of the projectile and the circumferential extent of the probe being limited, so that a voltage-gradient is developed between said probes when the longitudinal center axis of the projectile is at an agle to an external electrostatic field, whereby the fuze will have high voltage-gradient sensitivity in a direction transverse to said longitudinal center axis:

(b) a voltage sensitive electronic firing circuit, said pair of conducting probes connected to said circuit to cause said circuit to detonate said projectile when the voltage difference between said probes exceeds a predetermined amount.

3. A voltage-gradient sensitive proximity fuze for use with a rotating projectile against electrostatically charged targets, and which will detonate the projectile at an optimum distance from the target comprising:

(a) a pair of conducting electrostatic probes, said electrostatic probes being arranged symmetrically with respect to a plane of symmetry containing the longitudinal center axis of the projectile, said probes being of such limited circumferential extent that a voltage-gradient is developed between said probes when the longitudinal center axis of the projectile is at an angle to an external electrostatic field, whereby the fuze will have a high voltage-gradient sensitivity in a direction transverse to said longitudinal center axis:

(b) a voltage sensitive electronic firing circuit, said firing circuit including an electron tube normally cut-off, said tube having a plate, a control grid, and a cathode, one of said pair of probes connected to the control grid of said tube, the other of said probes connected to the cathode causing said tube to conduct when the potential difference between said probes a predetermined amount.

* * * * *